US010236585B2

(12) United States Patent
Nysen et al.

(10) Patent No.: US 10,236,585 B2
(45) Date of Patent: Mar. 19, 2019

(54) ISOLATED MULTIBAND TUBULAR DIPOLE

(71) Applicant: Netgear, Inc., San Jose, CA (US)

(72) Inventors: Paul Nysen, San Jose, CA (US); Chia-Wei Liu, Fremont, CA (US)

(73) Assignee: NETGEAR, INC., San Jose, CA (US)

( * ) Notice: Subject to any disclaimer, the term of this patent is extended or adjusted under 35 U.S.C. 154(b) by 64 days.

(21) Appl. No.: 15/043,470

(22) Filed: Feb. 12, 2016

(65) Prior Publication Data

US 2017/0237172 A1 Aug. 17, 2017

(51) Int. Cl.

| | |
|---|---|
| ***H01Q 9/28*** | (2006.01) |
| ***H01Q 5/15*** | (2015.01) |
| ***H01Q 1/24*** | (2006.01) |
| ***H01Q 9/16*** | (2006.01) |
| ***H01Q 9/22*** | (2006.01) |
| ***H01Q 5/314*** | (2015.01) |
| ***H01Q 5/371*** | (2015.01) |

(52) U.S. Cl.

CPC ..... *H01Q 9/28* (2013.01); *H01Q 1/24* (2013.01); *H01Q 5/15* (2015.01); *H01Q 5/314* (2015.01); *H01Q 5/371* (2015.01); *H01Q 9/16* (2013.01); *H01Q 9/22* (2013.01)

(58) Field of Classification Search

CPC .. H01Q 9/28; H01Q 5/15; H01Q 9/16; H01Q 1/24; H01Q 9/22

USPC ..... 343/795, 791, 702

See application file for complete search history.

(56) References Cited

U.S. PATENT DOCUMENTS

| | | | | |
|---|---|---|---|---|
| 2,486,597 | A * | 11/1949 | Greene | H01Q 21/10 343/791 |
| 4,205,319 | A * | 5/1980 | Gasparaitis | H01Q 1/085 343/702 |
| 4,746,925 | A | 5/1988 | Toriyama | |
| 4,998,895 | A * | 3/1991 | Forney | H01R 9/0518 439/585 |
| 5,173,715 | A | 12/1992 | Rodal et al. | |
| 6,339,405 | B1 | 1/2002 | Gleener | |
| 2012/0194401 | A1 | 8/2012 | McLean et al. | |
| 2014/0313087 | A1 | 10/2014 | Jiang et al. | |
| 2015/0244075 | A1 * | 8/2015 | Platt | H01Q 1/38 343/792 |

* cited by examiner

*Primary Examiner* — Hai Tran

(74) *Attorney, Agent, or Firm* — Perkins Coie LLP

(57) ABSTRACT

A dual band end fed dipole provides at least two distinct operating frequencies, e.g. 2.45 GHz and 5.5 GHz. Properties of the antenna include low cost to manufacture, e.g. ease of automation; minimal manual labor to manufacture, e.g. reliability; dual band operation; broad bandwidth; good feed line isolation; omnidirectional beam pattern; minimal vertical beam squint; small diameter; and high efficiency. Embodiments of the invention provide a dual band end fed dipole with a low band trap on the feed side that requires minimal manual labor to manufacture because the antenna is formed from a single flat sheet of metal and soldering is replaced with crimping. Minimal dielectric loading is also achieved.

15 Claims, 21 Drawing Sheets

ISOLATED MULTIBAND TUBULAR DIPOLE

FIELD

The invention relates to antennas. More particularly, the invention relates to an isolated multiband tubular dipole.

BACKGROUND

In radio and telecommunications a dipole antenna is the simplest and most widely used class of antenna. In its simplest form, it consists of two identical conductive elements, such as metal wires or rods, which are usually bilaterally symmetrical. The driving current from the transmitter is applied, or for receiving antennas the output signal to the receiver is taken, between the two halves of the antenna. Each side of the feed line to the transmitter or receiver is connected to one of the conductors.

The most common form of dipole is two straight rods or wires oriented end to end on the same axis, with the feed line connected to the two adjacent ends. Dipoles are resonant antennas, meaning that the elements serve as resonators, with standing waves of radio current flowing back and forth between their ends. The length of the dipole elements is determined by the wavelength of the radio waves used. The most common form is the half-wave dipole, in which each of the two rod elements is approximately ¼ wavelength long, and the whole antenna is a half-wavelength long. The radiation pattern of a vertical dipole is omnidirectional; it radiates equal power in all azimuthal directions perpendicular to the axis of the antenna. For a half-wave dipole the radiation is maximum, 2.15 dBi perpendicular to the antenna axis, falling monotonically with elevation angle to zero on the axis, off the ends of the antenna.

Several different variations of the dipole are also used, such as the folded dipole, short dipole, cage dipole, bow-tie, and batwing antenna. Dipoles may be used as standalone antennas themselves, but they are also employed as feed antennas (driven elements) in many more complex antenna types, such as the Yagi antenna, parabolic antenna, reflective array, turnstile antenna, log periodic antenna, and phased array.

FIG. 1 is a schematic representation of a center fed, multiband dipole antenna. In FIG. 1, a high band dipole element 10 and a low band dipole element 12 are connected to a transmitter and/or receiver at a center feed point 11. The antenna in FIG. 1 is a parallel dipole. In the parallel design, several dipoles are joined together in the center and fed with the same cable. The dipole that radiates the RF is the one that presents an impedance that most closely matches the cable (50 ohms). That matching impedance changes according to the frequency of the signal. One dipole offer a 50-ohm match on, e.g. a low band, while another provides the best match on, e.g. a high band.

FIG. 2 is a schematic representation of an end and center fed, multiband dipole antenna. In FIG. 2, a high band dipole element 20 and a low band dipole element 22 are respectively connected to a transmitter and/or receiver at one of an end feed point 23 and a center feed point 21.

A dipole is a symmetrical antenna because it is composed of two symmetrical ungrounded elements. Therefore, it works best when fed by a balanced transmission line because in that case the symmetry matches and therefore the power transfer is extremal. When a dipole with an unbalanced feed line such as coaxial cable is used for transmitting, the shield side of the cable, in addition to the antenna, radiates. This can induce radio frequency (RF) currents into other electronic equipment near the radiating feed line, causing RF interference. Furthermore, the antenna is not as efficient as it could be because it is radiating closer to the ground and its radiation pattern may be asymmetrically distorted. At higher frequencies, where the length of the dipole becomes significantly shorter than the diameter of the feeder cable, this becomes a more significant problem. To prevent this, dipoles fed by coaxial cables have a balun between the cable and the antenna, to convert the unbalanced signal provided by the coax to a balanced symmetrical signal for the antenna. FIG. 3 is a schematic representation of a balanced multiband dipole antenna that is connected at a center feed 30 point to a transmitter and/or receiver via a balun 31 to a coax feed 32.

FIG. 4 is a schematic representation of a balanced end fed, multiband trap dipole antenna. An antenna trap can be described as being an application of a resonant circuit. Such a trap, using a parallel resonant tuned circuit, offers very high impedance at or near resonance and acts as an insulator to effectively cut off the element to a length resonant to the band being used. In FIG. 4, an end feed coax 40 has a coax center conductor contact point 43. A low band trap 41 and a high band trap 42 allow the antenna to resonate properly at both high band and low band frequencies.

SUMMARY

A dual band end fed dipole provides at least two distinct operating frequencies, e.g. 2.45 GHz and 5.5 GHz. Properties of the antenna include low cost to manufacture, e.g. ease of automation; minimal manual labor to manufacture, e.g. reliability; dual band operation; broad bandwidth; good feed line isolation; omnidirectional beam pattern; minimal vertical beam squint; small diameter; and high efficiency. Embodiments of the invention provide a dual band end fed dipole with a low band trap on the feed side that requires minimal manual labor to manufacture because the antenna is formed from a single flat sheet of metal and soldering is replaced with crimping. Minimal dielectric loading is also achieved.

DRAWINGS

DESCRIPTION

A dual band end fed dipole provides at least two distinct operating frequencies, e.g. 2.45 GHz and 5.5 GHz. Properties of the antenna include low cost to manufacture, e.g. ease of automation; minimal manual labor to manufacture, e.g. reliability; dual band operation; broad bandwidth; good feed line isolation; omnidirectional beam pattern; minimal vertical beam squint; small diameter; and high efficiency. Embodiments of the invention provide a dual band end fed dipole with a low band trap on the feed side that requires minimal manual labor to manufacture because the antenna is formed from a single flat sheet of metal and soldering is replaced with crimping. Minimal dielectric loading is also achieved by use of metal only construction.

An important aspect of the antenna disclosed herein is the antenna's form factor. In the presently preferred embodiment, the antenna should be small enough to fit within, for example, a plastic tube having an inner diameter of 7 mm or a cross section of 6 mm by 5 mm and an overall length of 160 mm. Those skilled in the art will appreciate that the invention may be practiced in any desired form factor.

Given the requirements of a compact form factor, conventional approaches to forming a multiband dipole are not sufficient. For example, one goal of such antenna is to reduce noise to the antenna from a main PCB and to reduce the squint in the antenna vertical beam pattern. In embodiments of the invention, isolation and beam symmetry are achieved by use of an RF trap on the feed side of the coax cable. The coax side of antenna structure is preferably formed from a single sheet of metal to maintain dimensional requirements and provide for crimps as required to eliminate soldering. A small plastic spacer is required for the distal end.

Figure 4:
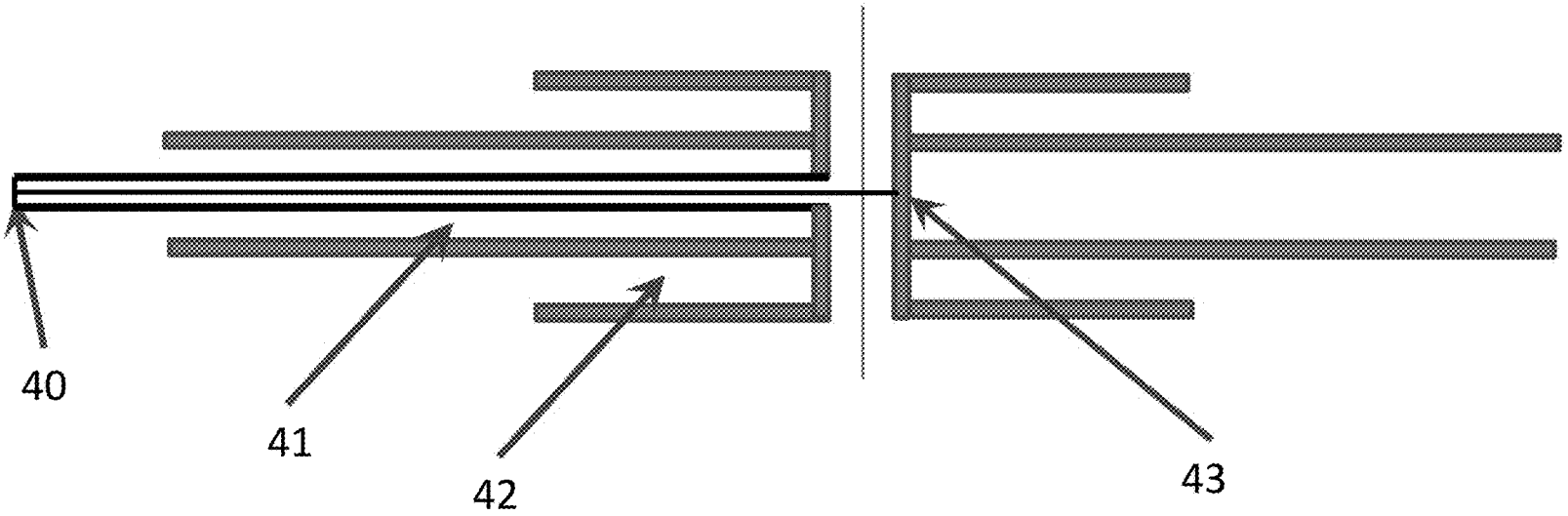
FIGURE 4 (PRIOR ART)
FIG. 4 is a schematic representation of a balanced end fed, multiband trap dipole antenna.
Figure 5:
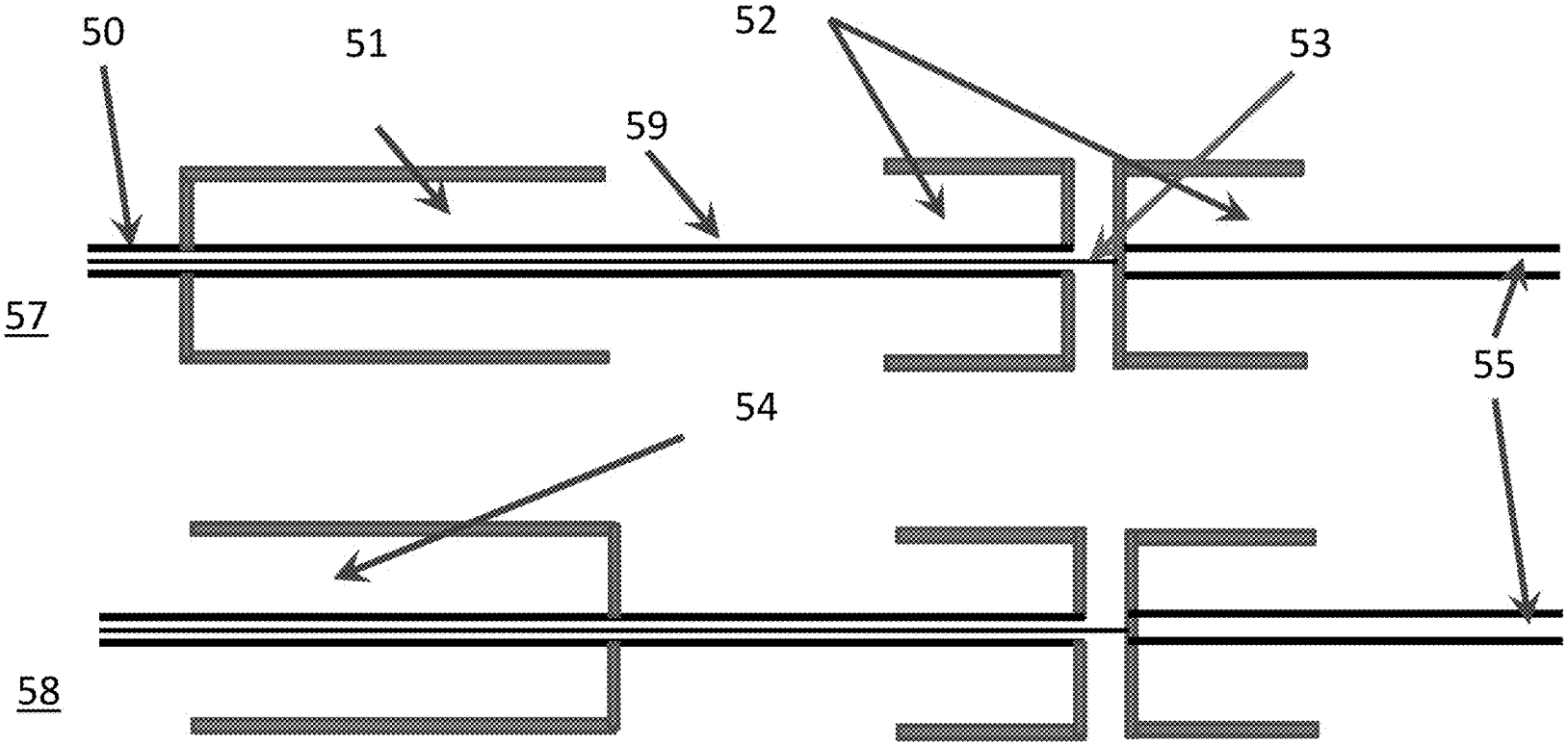
FIG. 5 is a schematic representation of an end fed, multiband trap dipole antenna according to the invention.

FIG. 5 is a schematic representation of an end fed, multiband trap dipole antenna according to the invention (cf. FIG. 4, which comprises that state of the art).

Figure 1:
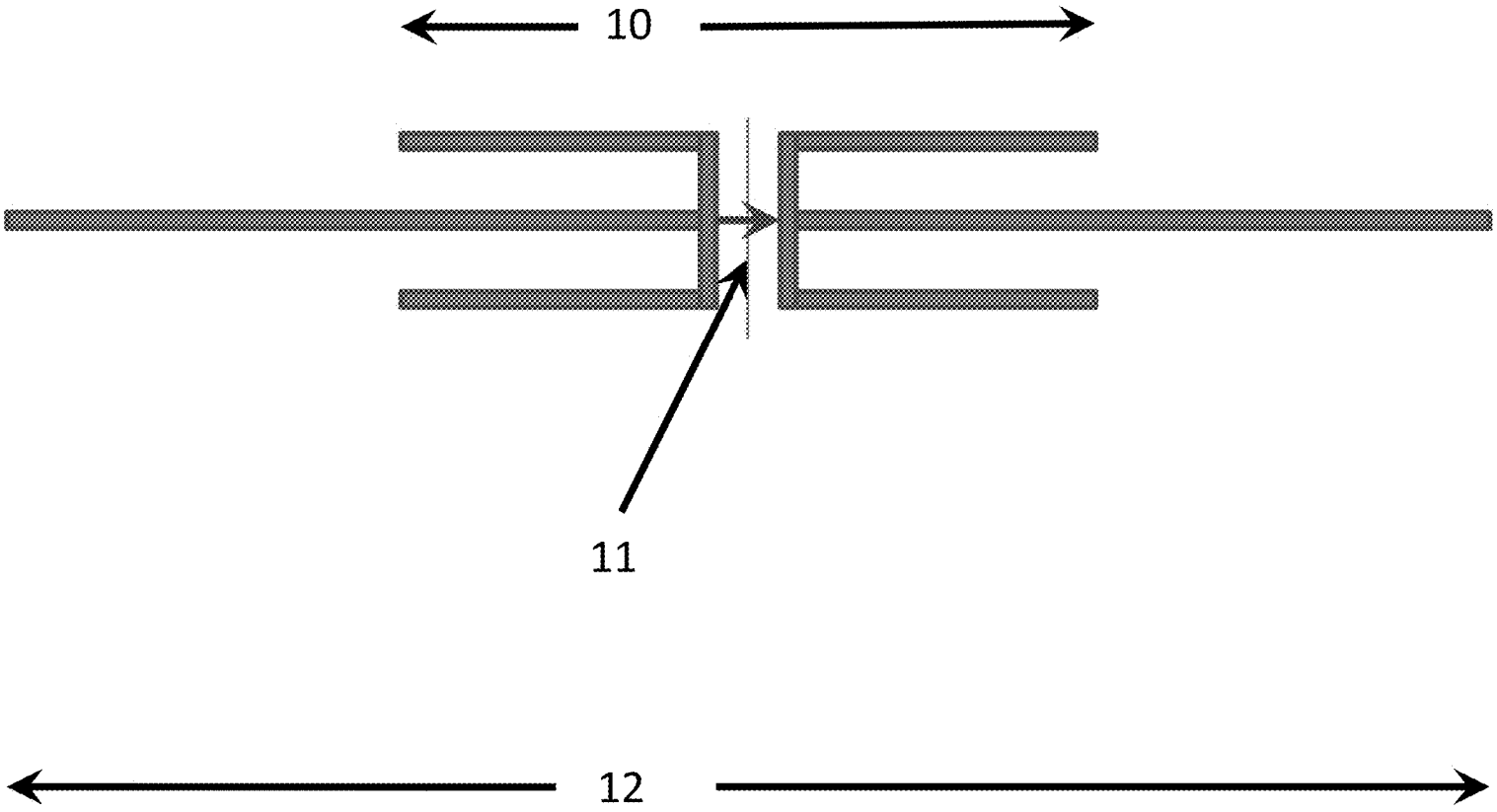
FIGURE 1 (PRIOR ART)
FIG. 1 is a schematic representation of a center fed, multiband dipole antenna.
Figure 2:
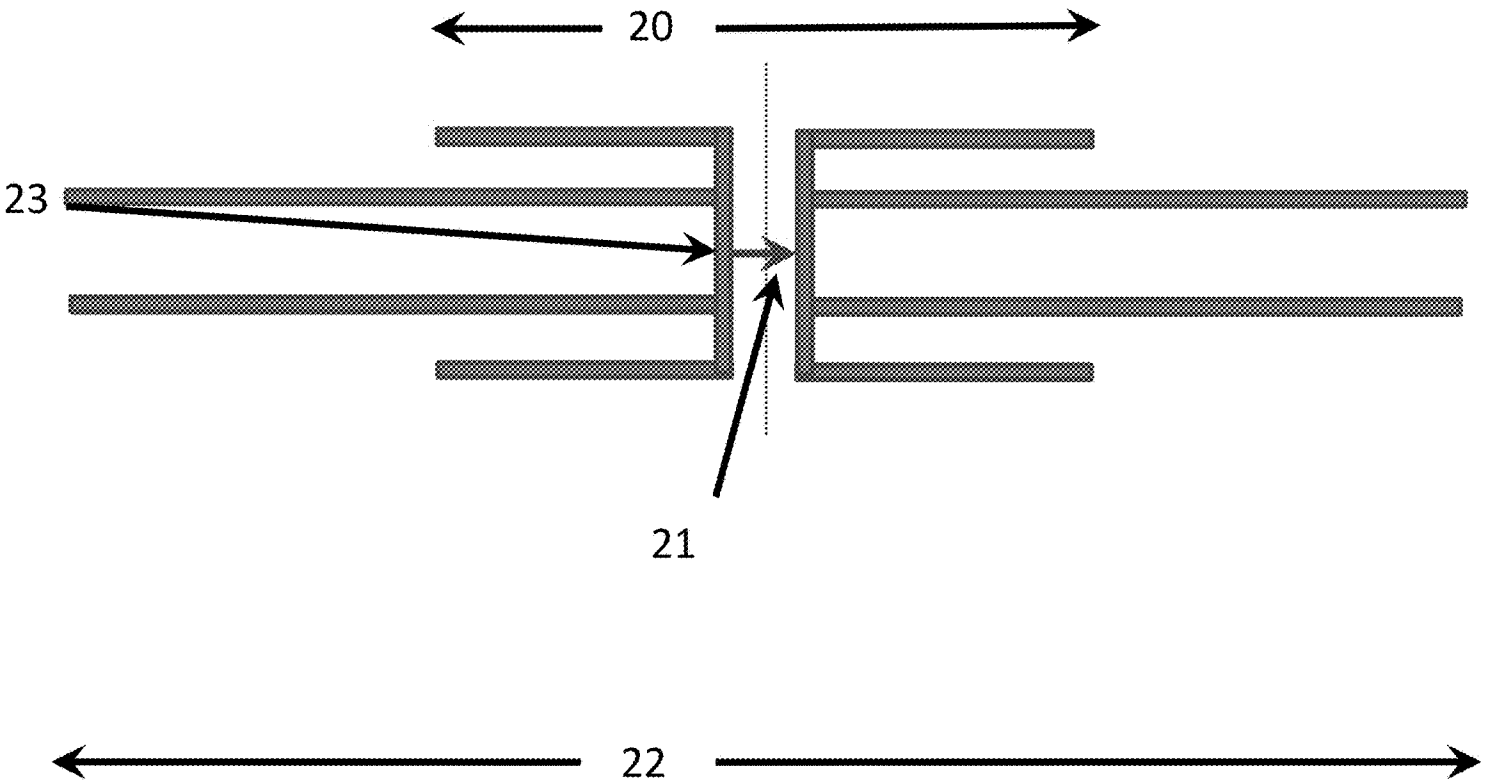
FIGURE 2 (PRIOR ART)
FIG. 2 is a schematic representation of an end and center fed, multiband dipole antenna.
Figure 3:
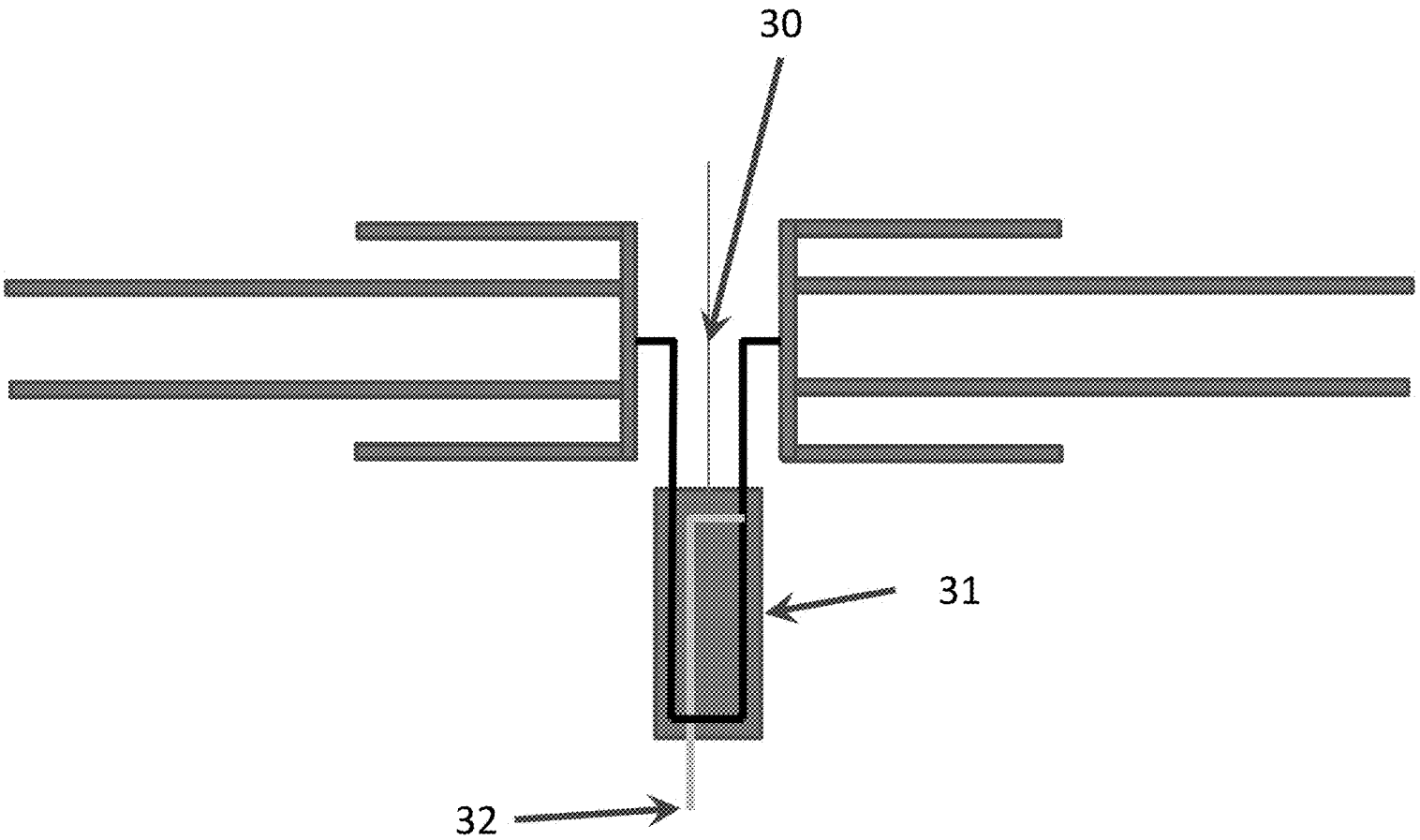
FIGURE 3 (PRIOR ART)
FIG. 3 is a schematic representation of a balanced center fed, multiband dipole antenna that is connected to a transmitter and/or receiver via a balun to a coax feed.

In FIG. 1, dipole #1(57) is a presently preferred candidate to achieve the above-mentioned goals. Such structure provides high band functionality by using an inner dipole 59. This part of the antenna is essentially a standard broad band dipole that is omnidirectional with no vertical squint. The open nature of the dipole ends results in a high impedance at both ends because the open ends are nominally one quarter of a wavelength at the high band. This ensures that no significant currents in the high band can travel down the feed line.

In this embodiment, the low band dipole is based on the thinner structure 55 that extends beyond the high band traps 52 by a length of one quarter of a wavelength at the low band from the dipole feed point 53. At the end away from the feed line the antenna is open and hence exhibits high impedance. The end on the feed line needs a high impedance at the low band to remain isolated from the feed cable. Essentially, an RF trap 51 at the low band is required at the point where the dipole becomes resonant in the low band. This is achieved in this embodiment by using a sleeve trap resonant at the low band. The sleeve trap is easily formed by folding the sheet metal back on itself to create the low band trap. Of particular note is that sleeve can be formed as an open cavity slot with three sides only. The fourth side is the open side. Electrically this behaves as an air-based micro-strip transmission line. Thus, an important aspect of embodiments of the invention is that the trap and dipole can be formed from a single sheet of metal.

In like fashion, the high band trap sleeves may also be open on one of the four sides.

See FIG. 7 (discussed below) with regard to how the feed end of the dipole and low band trap can be folded from one sheet of metal.

Another important aspect of embodiments of the invention is that the feed coax line is captured on the interconnecting inner line that connects the trap to the high band dipole. This is further strengthened by making the interconnecting line into a saddle that is bent up on the sides thus stiffening it (see FIG. 6, discussed below). This saddle ensures correct spacing between the resonator and the high band dipole. The coax is secured in the channel by a set of four crimp tabs that crimp the coax to the saddle. One result of this design is consistency of manufacture. Those skilled in the art will appreciate that the number of crimp tabs can be varied as appropriate.

A further important aspect of embodiments of the invention is that the coax center conductor is directly connected to the remote side, which only requires the other half of the high band dipole and a length of channel, i.e. a saddle, folded through it with a nominal length of a quarter wavelength. This connection is supported by a dielectric spacer (see FIG. 9, discussed below). In embodiments, this structure is fully supported inside a plastic antenna tube.

With reference again to FIG. 5, the first, preferred embodiment, dipole #1 (57) includes an end feed coax 50 and coax center conductor contact point 53. A high band trap 52, and high band 59 and low band radiators 55 are provided. A low band trap 51 is formed on the left side of the structure. At the open end of the low band trap the effective impedance at the low band is very high and, therefore, the low band makes the dipole appear to be disconnected from the feed cable from the left. Advantageously, the low band trap can be implemented with a single stamping.

In FIG. 5, in a second, less preferred embodiment, dipole #2 (54), the low band trap 54 is not suitable for a single bent sheet construction, and the arrangement is harder to resonate at the required low band frequency. While dielectric loading could be used to permit this, such arrangement adds weight and loss to the antenna. Nonetheless, this embodiment is within the scope of the invention.

Figure 6:
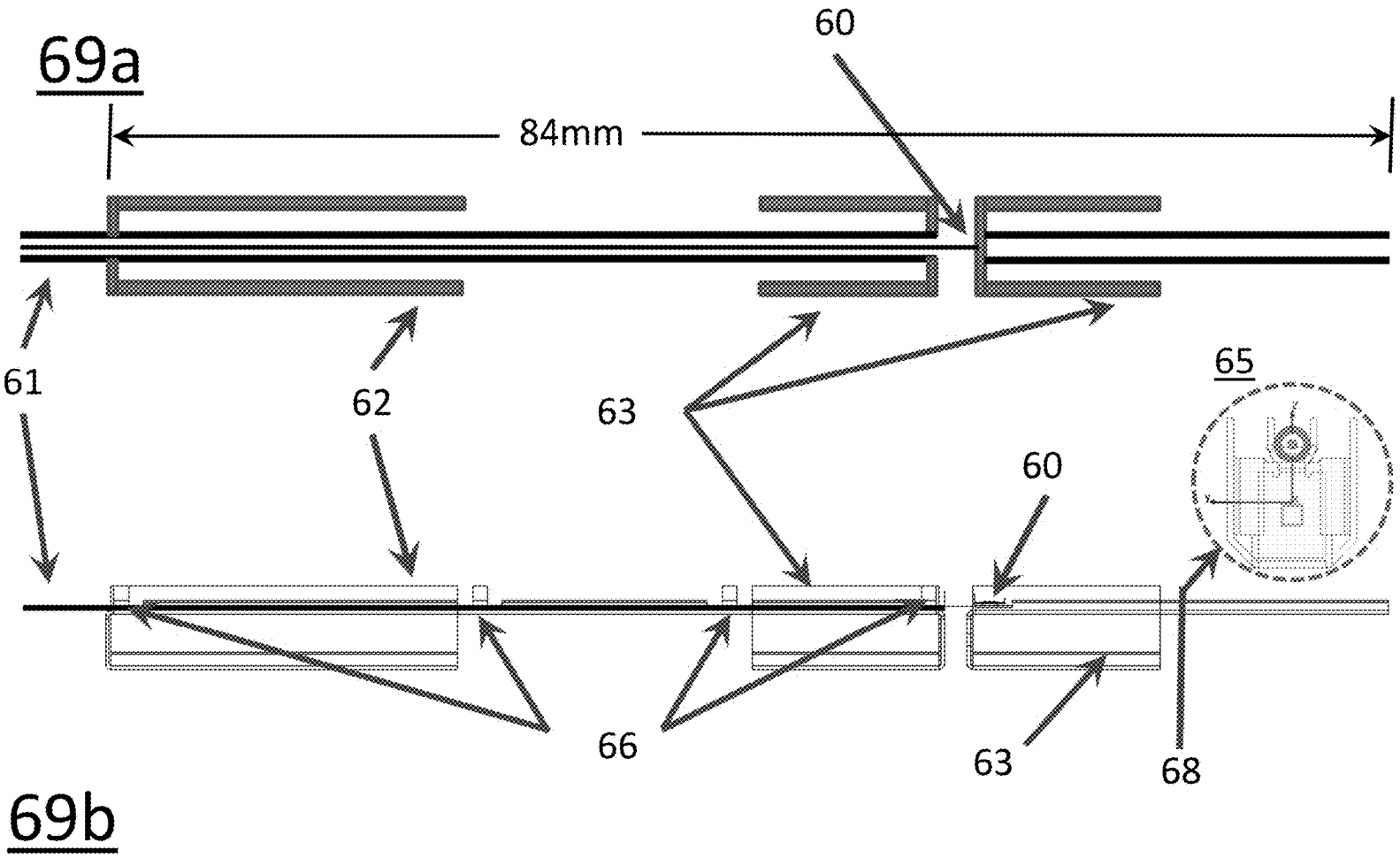
FIG. 6 is a plan view of an end fed, multiband trap dipole antenna according to the invention.
Figure 7:
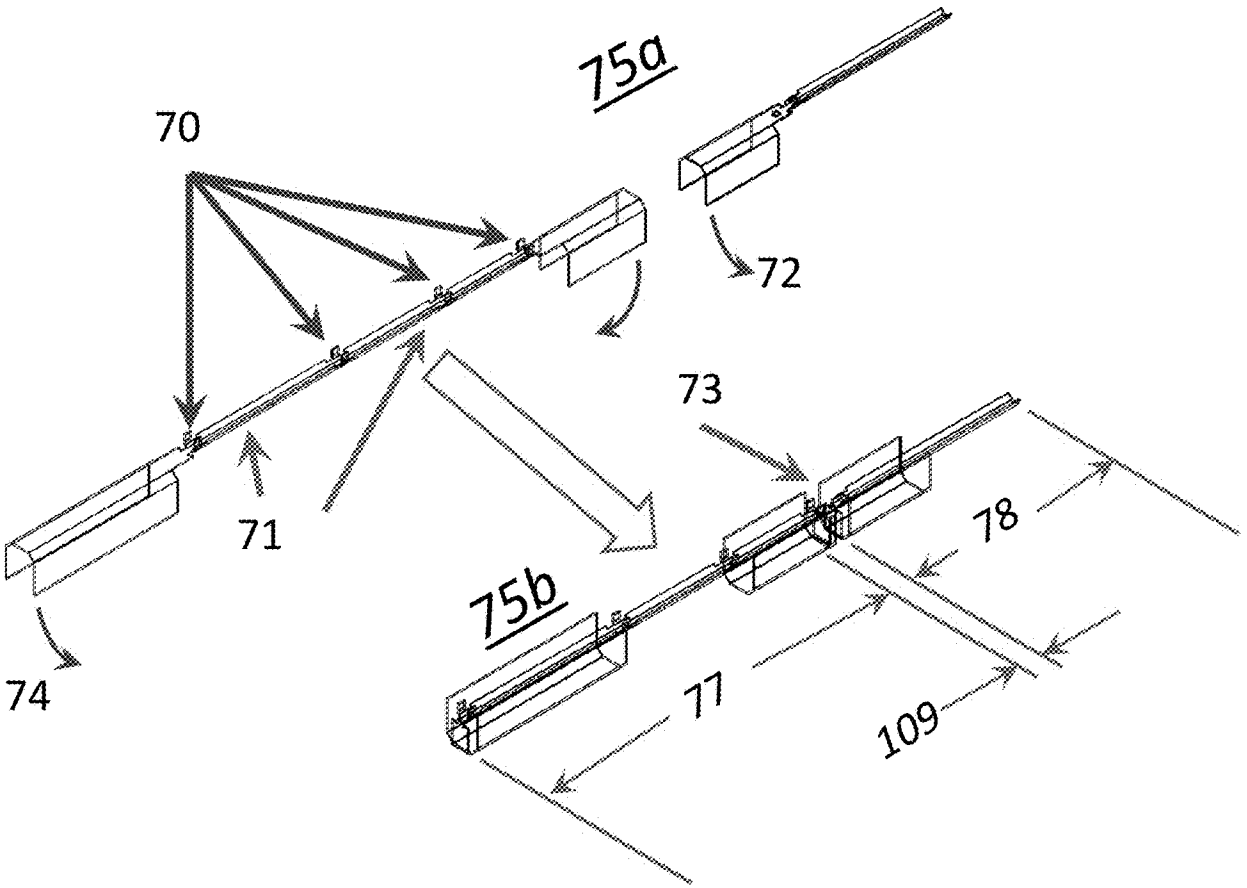
FIG. 7 is a perspective view of an end fed, multiband trap dipole antenna according to the invention.

FIGS. 6 and 7 show construction details of a multiband dipole antenna, in which FIG. 6 is a plan view of an end fed, multiband trap dipole antenna according to the invention; and FIG. 7 is a perspective view of an end fed, multiband trap dipole antenna according to the invention.

In FIG. 6, a conceptual representation 69*a* of the antenna includes an end feed coax cable 61 having a coax center conductor solder point 60. The antenna includes a low band trap 62 and a high band traps 63.

An end view 65 of the antenna shows the folded nature of the trap structures. In embodiments of the invention, this allows the antenna to have a diameter of 7 mm (68). The folded nature of the traps is also seen in an implementation representation 69*b* of the antenna. The low band trap 62 and high band trap 63 are folded. The coax shield is shown crimped to the antenna structure at various crimp points 66.

FIG. 7 shows a single sheet implementation of the feed side of the dipole. A top portion of FIG. 7 (75*a*) shows the unfolded metal of the trap; a bottom portion of FIG. 7 (75*b*) shows the folded metal structure of the trap, where the trap structures have been bent 180° (72, 74) to form the three-sided structure discussed above.

To complete the assembly of the antenna, a coax cable with its jacket removed, exposing the braid or shield to make an electrical connection to the antenna, is attached at crimp points 70 to a coax saddle 71. The coax shield is crimped at the four crimp points to the feed side antenna structure. The shield is removed from the coax at and beyond the exit point. The coax inner dielectric is removed a few millimeters beyond the exit point and the exposed coax center conductor is also trimmed a few millimeters past the dielectric.

A plastic spacer 73 is inserted, as shown in FIG. 7, to space (109) the feed side part 77 of the antenna from the remote side part 78 of the dipole.

Next, the coax conductor is captured at, and/or soldered to, the remote side of the dipole. Because the remote side of the dipole is only connected to the coax center conductor, it is isolated completely from the coax shield and ground. As such, ESD protection is typically required.

Finally, the antenna is inserted into a plastic sheath or tube (not shown) for final assembly.

Figure 8:
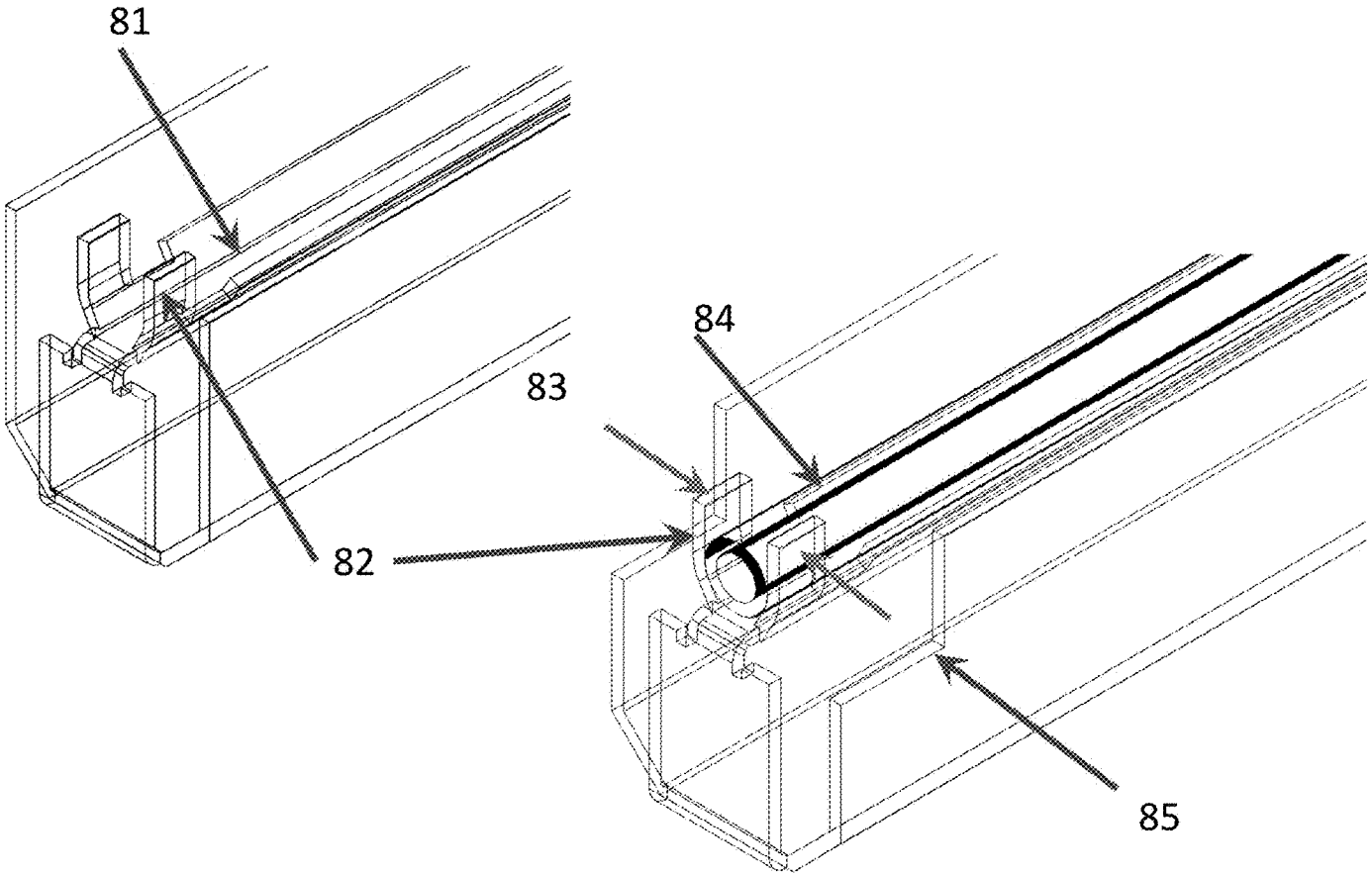
FIG. 8 is a detailed perspective view of an end fed, multiband trap dipole antenna showing coax shield crimping according to the invention.

FIG. 8 is a detailed perspective view of an end fed, multiband trap dipole antenna showing coax shield crimping according to the invention. In a presently preferred embodiment, the shield of the coax 84 is crimped to the coax shield saddle 81 at four crimp locations 82 by applying a crimp force 83 with a crimp tool (not shown) at least in manner shown in FIG. 8. The crimp tool requires access clearance 85 from both sides to be effective. Because crimping is employed in this embodiment, the use of any of many different types of sheet metal is possible, including stainless steel.

Figure 9:
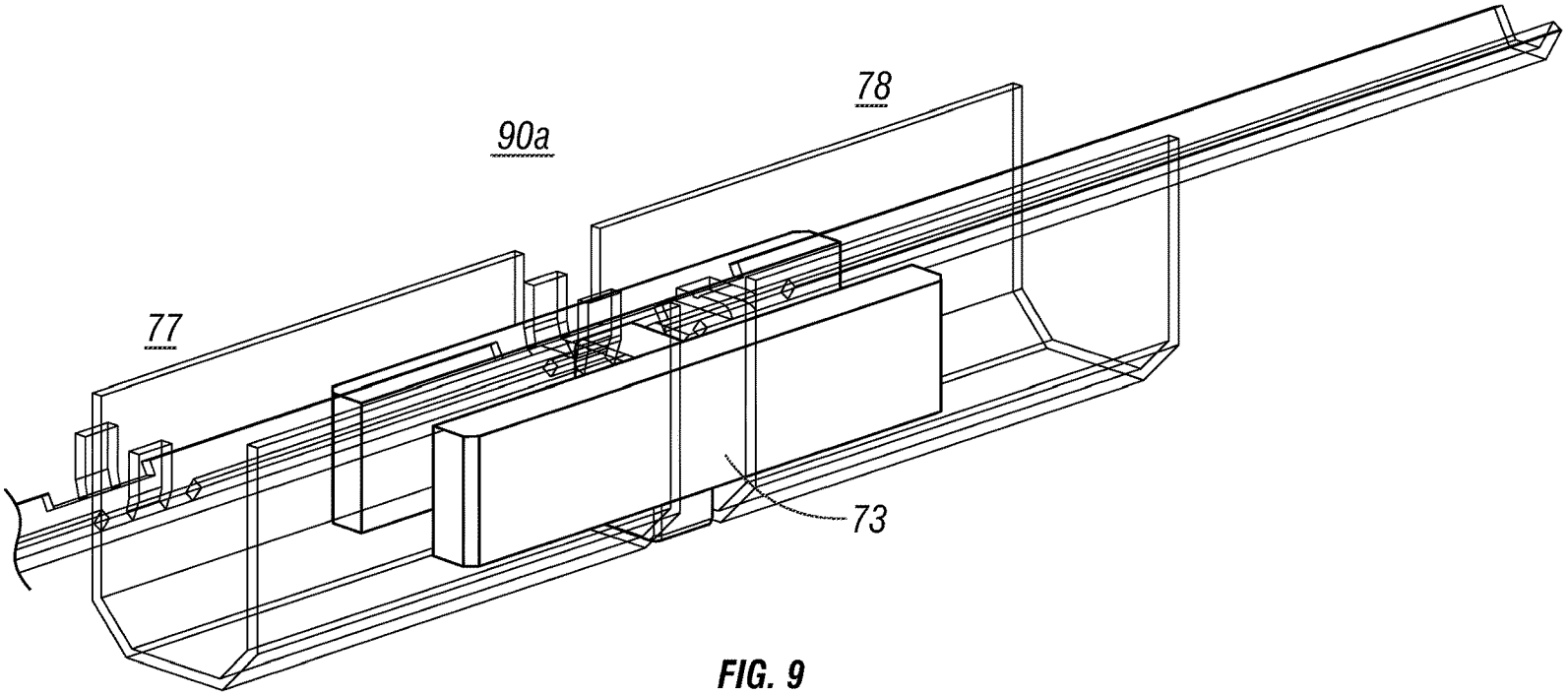
FIG. 9 is a detailed perspective view of an end fed, multiband trap dipole antenna showing antenna elements and assembly according to the invention.
Figure 9:
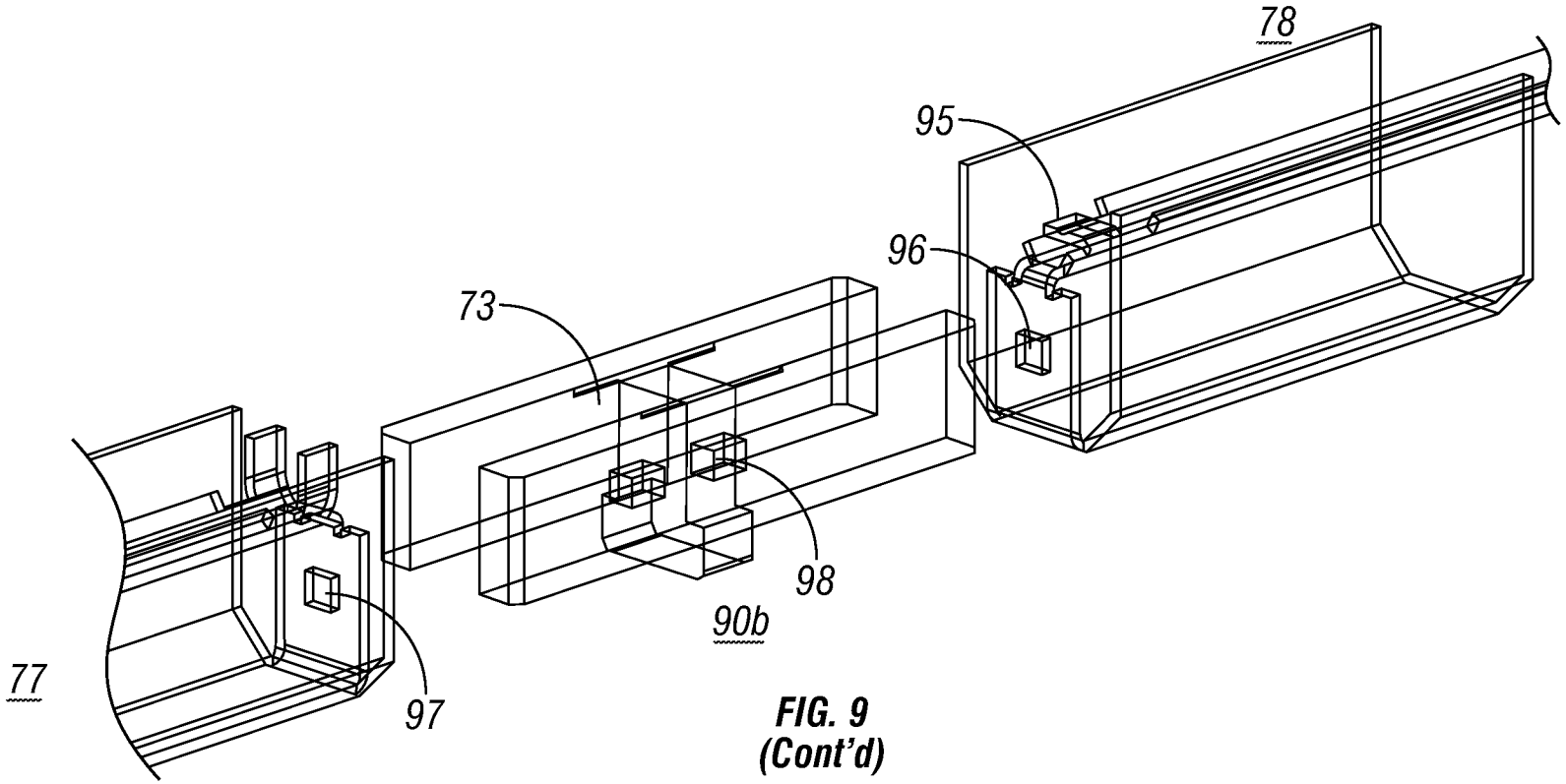

FIG. 9 is a detailed perspective view of an end fed, multiband trap dipole antenna showing antenna elements and assembly according to the invention. FIG. 9 provides both an assembled view 90*a* of the antenna and an exploded view 90*b* of the antenna. In FIG. 9, the dielectric spacer 73 between the feed side 77 and the remote side 78 of the antenna provides for controlled spacing between the two antenna elements (see the spacer gap 109 on FIG. 7). The spacer also provides stiffening between the two elements to resist bending. The spacer includes an alignment pin 98 and mating alignment hole 96, 97 for proper assembly. The spacer may be made from plastic or other dielectric materials.

During assembly, the pre-stripped coax is laid onto the entire assembly with the coax center conductor also aligned with its solder location 95 on the remote side 78. On the feed side, the coax jacket is completely removed to provide electrical continuity between the coax shield and the coax saddle that provides the crimps and dimensional control. The crimps on the feed side are closed onto the coax braid and/or shield.

Figure 10:
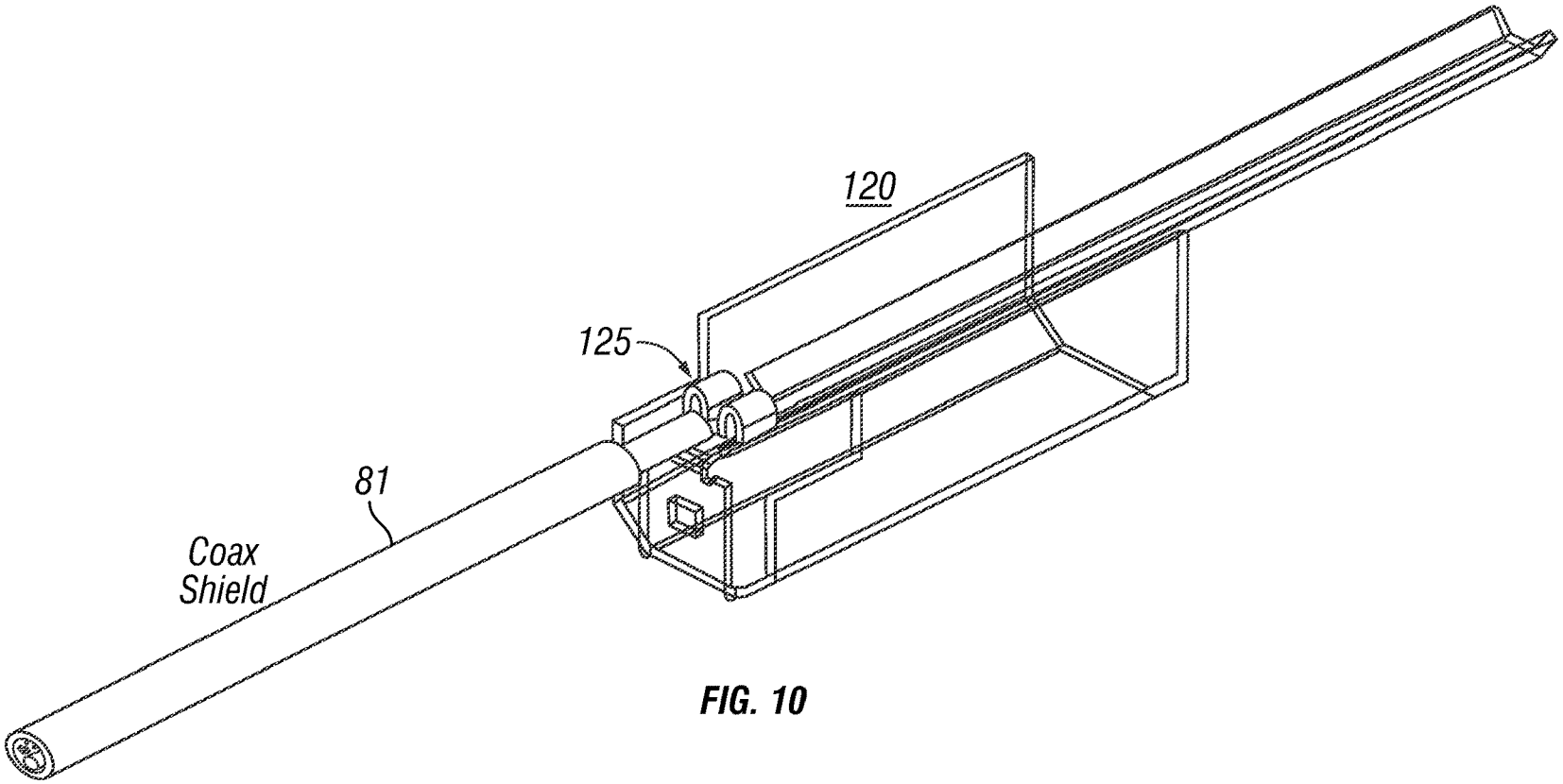
FIG. 10 is a detailed perspective view of an end fed, multiband trap dipole antenna showing conductor crimping according to the invention.
Figure 10:
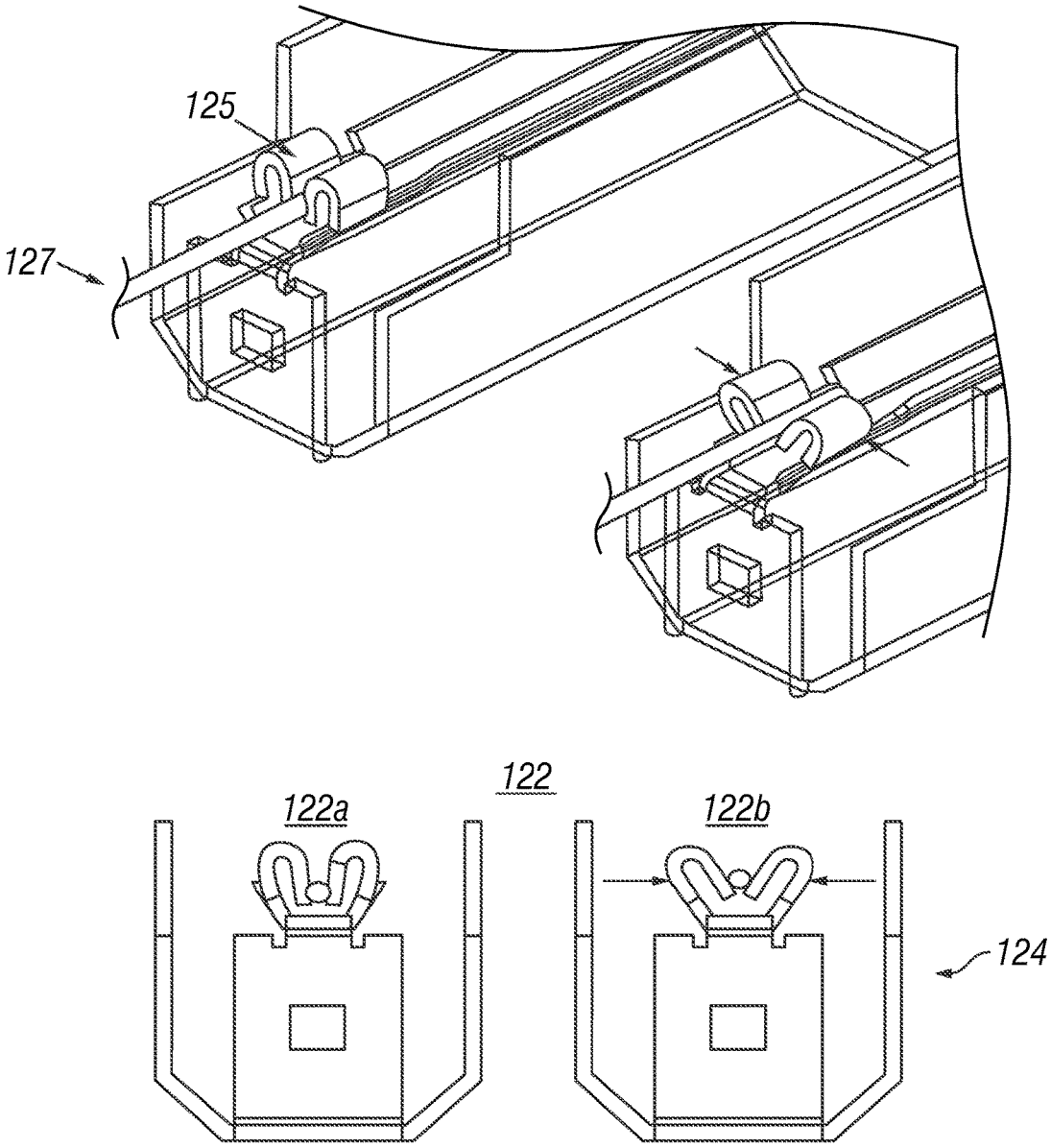
Figure 10:
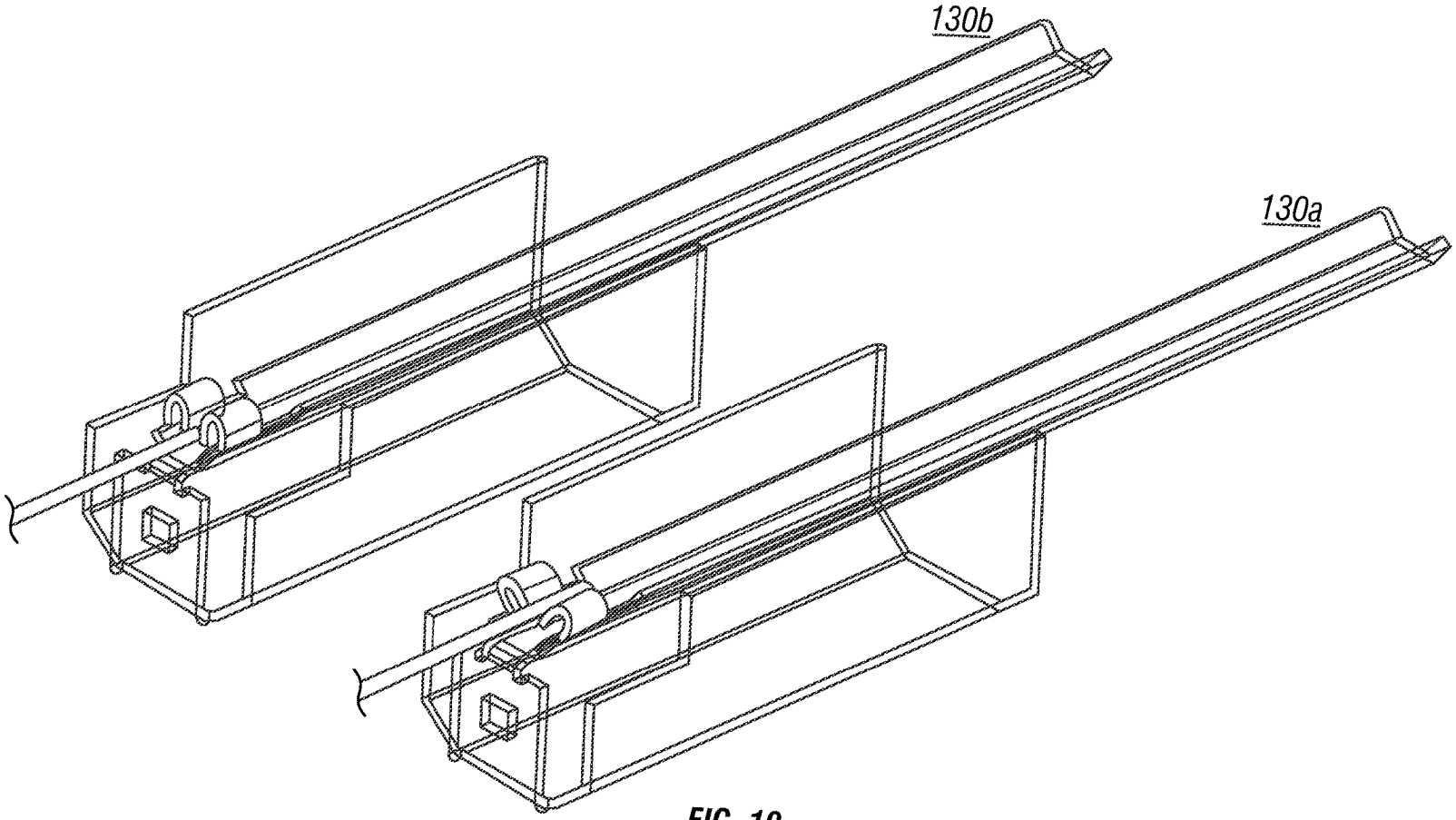

FIG. 10 is a detailed perspective view of an end fed, multiband trap dipole antenna showing conductor crimping according to the invention. Such crimping is provided in connection with the need to construct an antenna system that is connected to a coax cable without the use of solder. The invention provides an alternative to soldering, which is to crimp all electrical connections. As shown in FIG. 8, discussed above, an antenna system is based on crimping of the shield 81 of a coax to the antenna ground system. In this embodiment, it is necessary to solder the center conductor (see FIG. 10: 127) of the antenna coax. In some embodiments there is also a need for non-discrete, reactive components. In some embodiments, several center conductors may need to be connected at a single node. This is discussed below.

FIG. 10 details the design and process for capturing the coax conductor. First, the prepared coax is placed, all four shield crimps are closed by applying a crimping force, and the coax center conductor is soldered to the remote end antenna (active side).

In one approach to crimping the coax center conductor, at step 1 (130*a*), the prepared coax conductor is in position (as shown) and at step 2 (130*b*), the crimp is pushed down, thus locking the coax center conductor in place. A cross section view 122 shows a crimp before application of crimping force (122*a*) and after application of crimping force (122*b*). This embodiment eliminates the need to solder the coax inner conductor to the remote antenna assembly. This embodiment crimps the coax conductor 127 into the remote antenna. To achieve this, the metal at the conductor crimp location of the remote antenna is formed into two crimping lugs 125. Each lug is folded back on itself to provide the conductor capture mechanism. In this embodiment, the lugs are formed from the same metal sheet as used for the remote antenna by use of a progressive forming tool (not shown).

In FIG. 10, at Step 1 (130*a*), the coax center conductor placed into the crimping lugs 125. At step 2 (130*b*), a differential crimping force 124 is applied to the outside of the two lugs, causing the crimping lugs to plastically deform at the point where the lugs connect to the remote antenna assembly. While the lugs deform as indicated, the spring of the lug is only elastically displaced, thus maintaining spring force on the conductor. To ensure that the conductor does not slip out of the location, a groove is included in the lug to keep it captured as pressure is applied The crimp causes the conductor to be deflected downward by approximately one conductor diameter. This is acceptable. There is, however, a simple solution to this that is implemented by raising the crimp lug mechanism by one conductor diameter. The result is to locate the conductor in a relaxed position after completion of the crimp.

Finally, the metal sheet can be thinned at point where the lug connects to the remote antenna assembly to ensure plastic deformation occurs mainly at that point.

Figure 11:
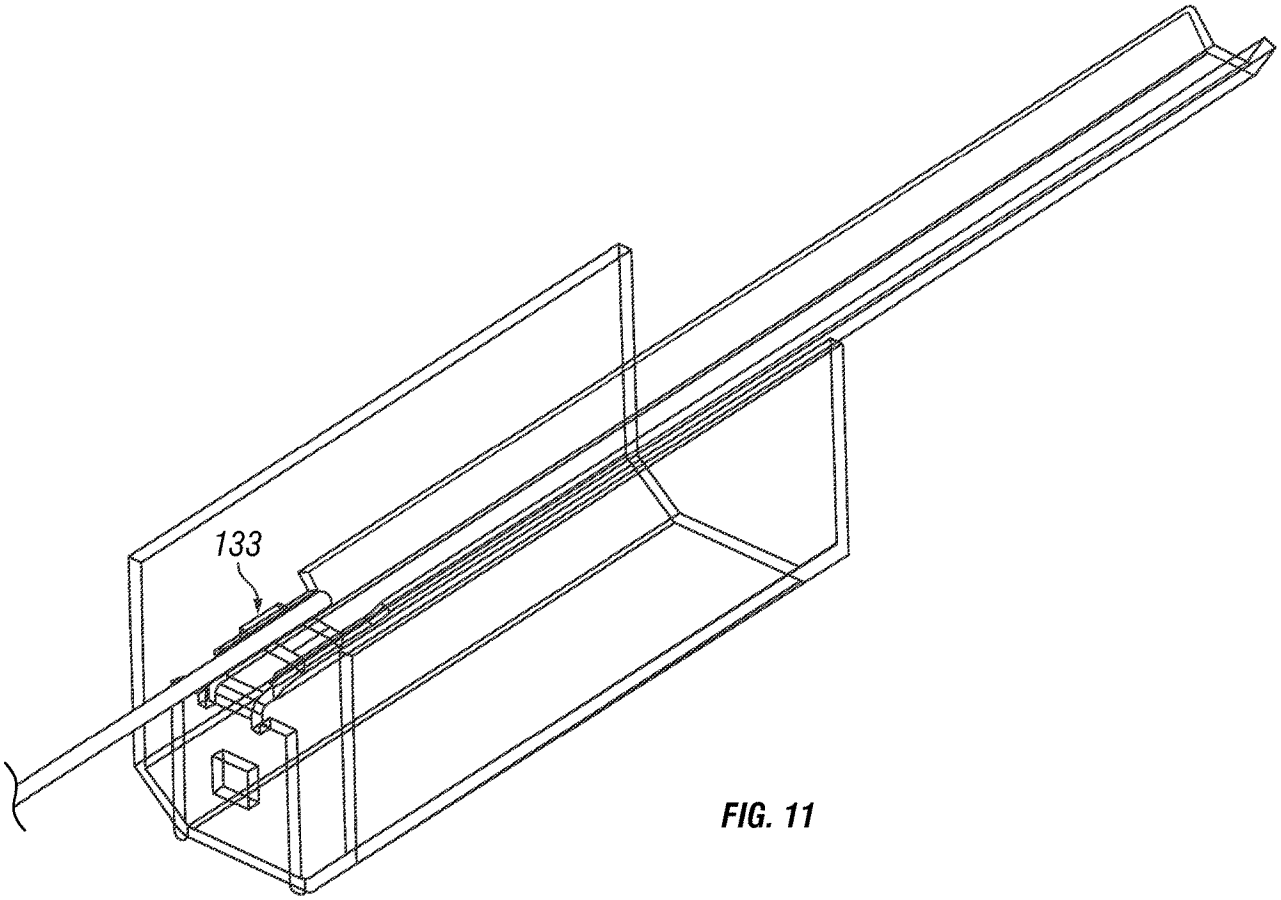
FIG. 11 is a further detailed perspective view of an end fed, multiband trap dipole antenna showing conductor crimping according to the invention.
Figure 11:
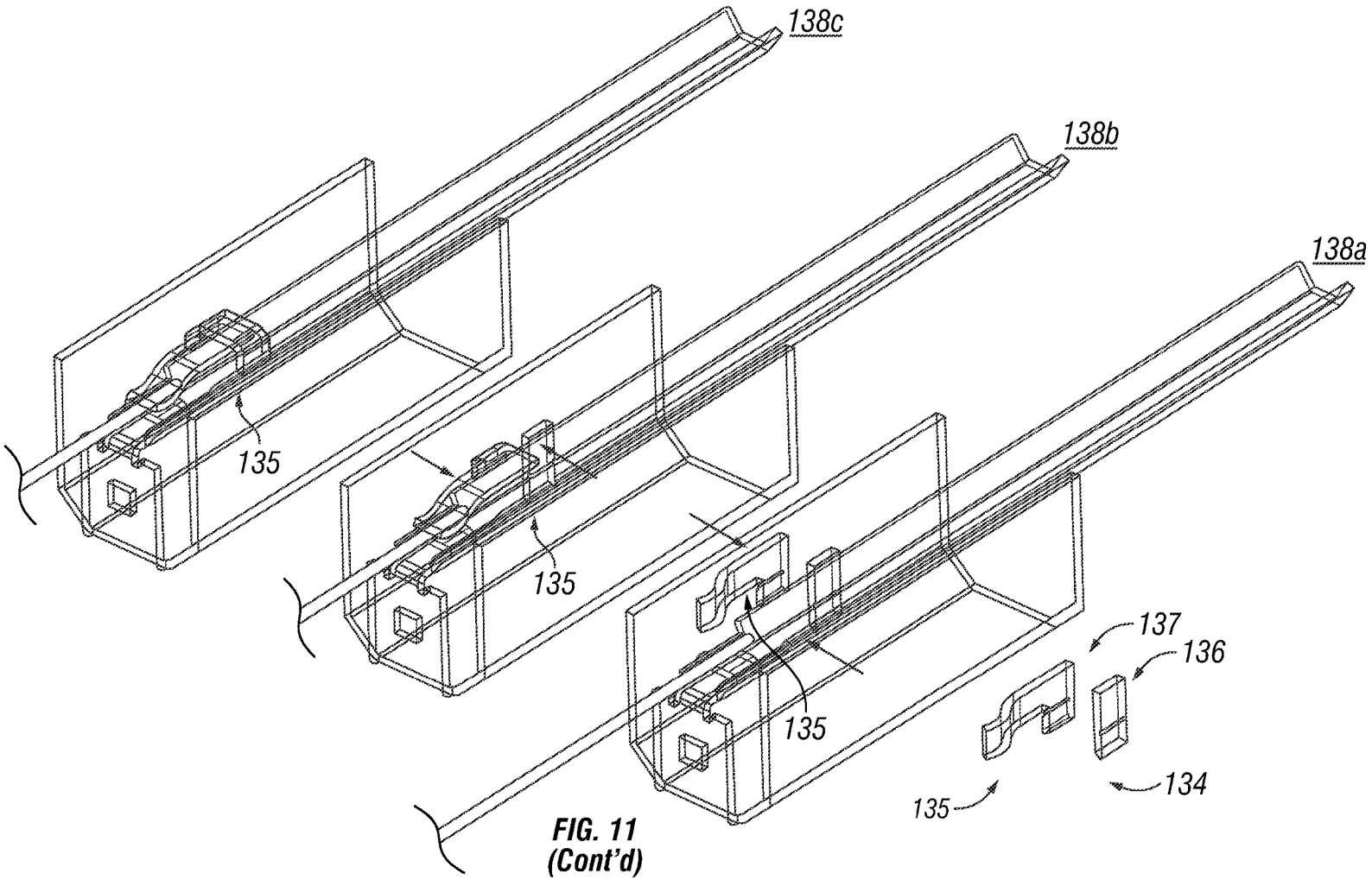

FIG. 11 is a further detailed perspective view of an end fed, multiband trap dipole antenna showing conductor crimping according to the invention. This embodiment uses a two-part mechanism 135 comprising a crimp 137 and lock 136. At Step 1 (138*a*), the prepared coax conductor 133 is in position as shown, At Step 2 (138*b*), crimping force 134 is applied and the crimp is bent onto the conductor. At Step 3 (138*c*), the lock is bent over the crimp.

The crimp 137 contacts the coax conductor onto the antenna base and also provides a spring action to ensure controlled pressure, i.e. spring action, on the coax conductor. The lock 136 closes over the crimp to prevent creep with aging. An access hole (not shown) can be cut into the bottom of the surrounding metal sheath used for the high band dipole, which hole allows for use of a tool during the crimping process.

Thus, embodiments of the invention eliminate the need to solder the coax inner conductor to the remote antenna assembly by crimping the coax conductor into the remote antenna. As show in FIG. 11 a conductor crimp location of the remote antenna is formed into two distinct parts comprising the spring clamp and the lock. These parts are formed from the same metal sheet as used for the remote antenna and are formed using a progressive forming tool.

Figure 12:
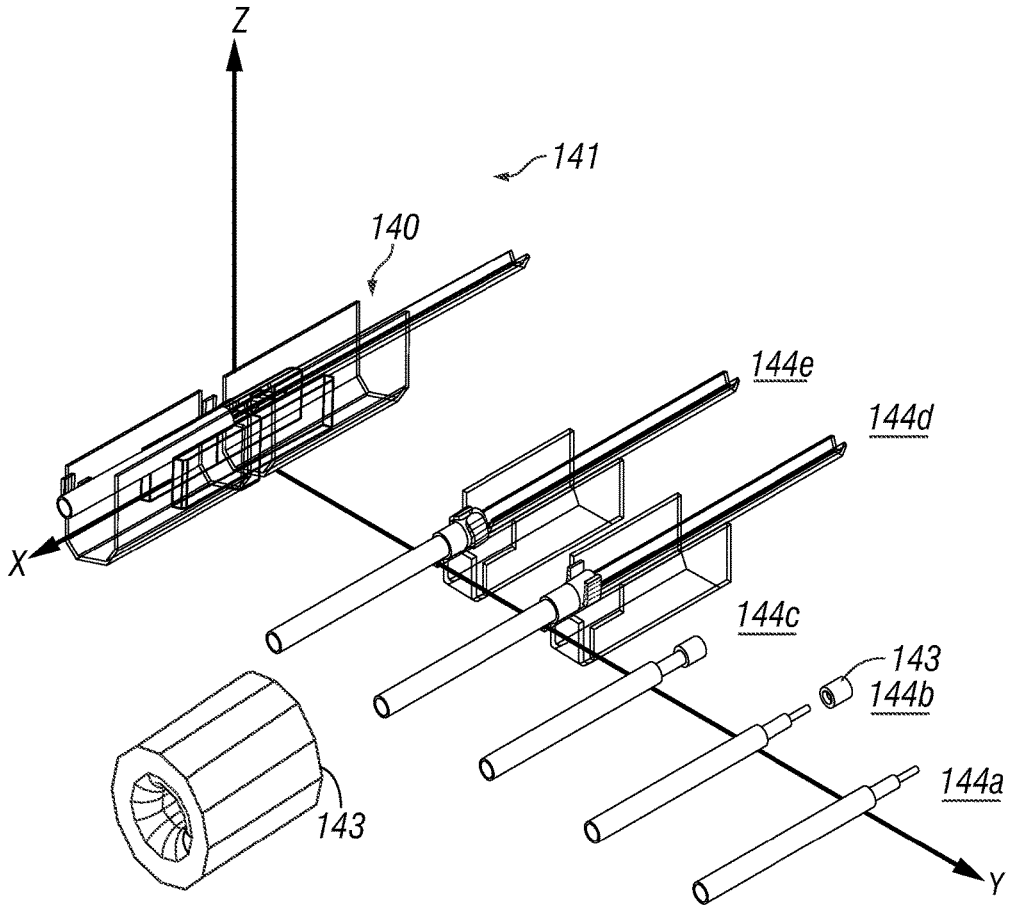
FIG. 12 is a detailed perspective view of an end fed, multiband trap dipole antenna showing a series of steps in connection with conductor crimping according to the invention.
Figure 12:
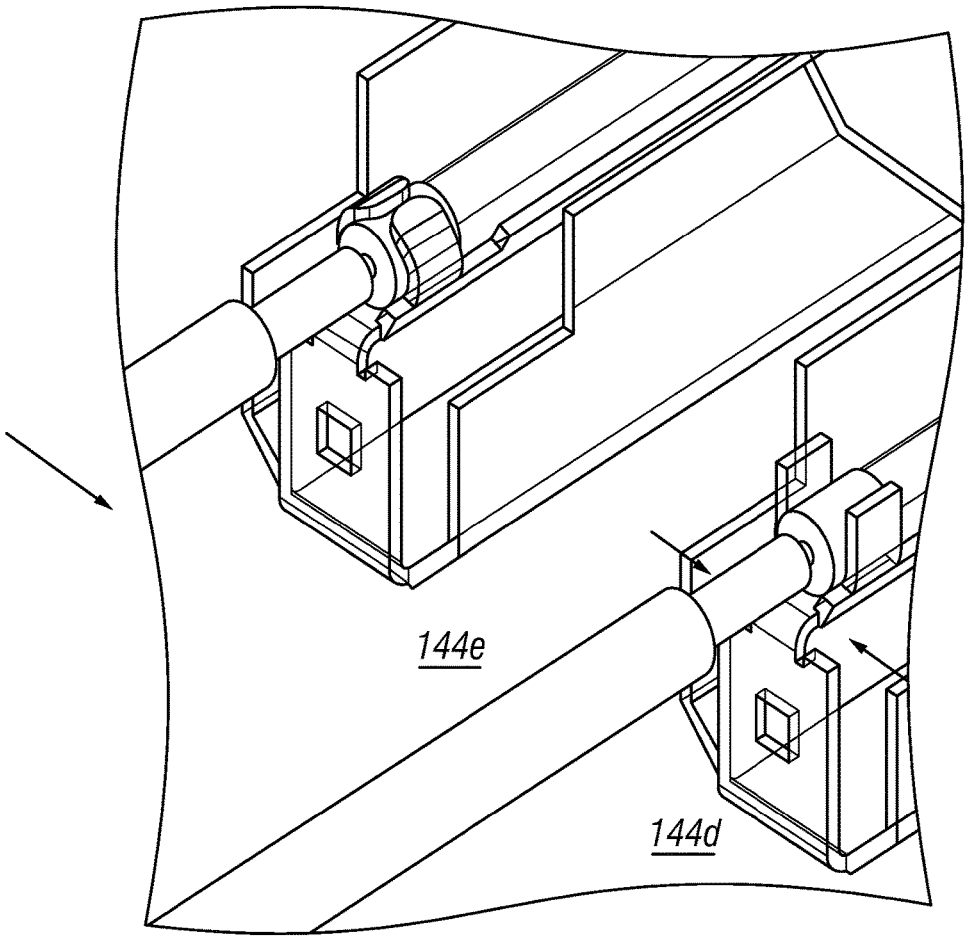

FIG. 12 is a detailed perspective view of an end fed, multiband trap dipole antenna showing a series of steps in connection with conductor crimping according to the invention. Crimping of the very fine coax conductor is not an easy assembly procedure. A further embodiment simplifies and ruggedizes the process by first clamping or swaging a soft metal ferrule 143 onto the coax center conductor 140. This assembly, in turn, can be crimped into the remote side of the antenna in the same way as done for the shield crimps on the feed side. That is, the coax is stripped (144*a*), the ferrule is placed over the center conductor (144*b*), the ferrule is swaged to the center conductor (144*c*), the center conductor and ferrule assembly is placed into a crimp mechanism that is similar to shield clamp (144*d*), and the crimp is completed by closing the crimp mechanism around the ferrule (144*e*). The crimp is now complete. This crimping process can be executed coincidentally with that of the four shield crimps.

Figure 13:
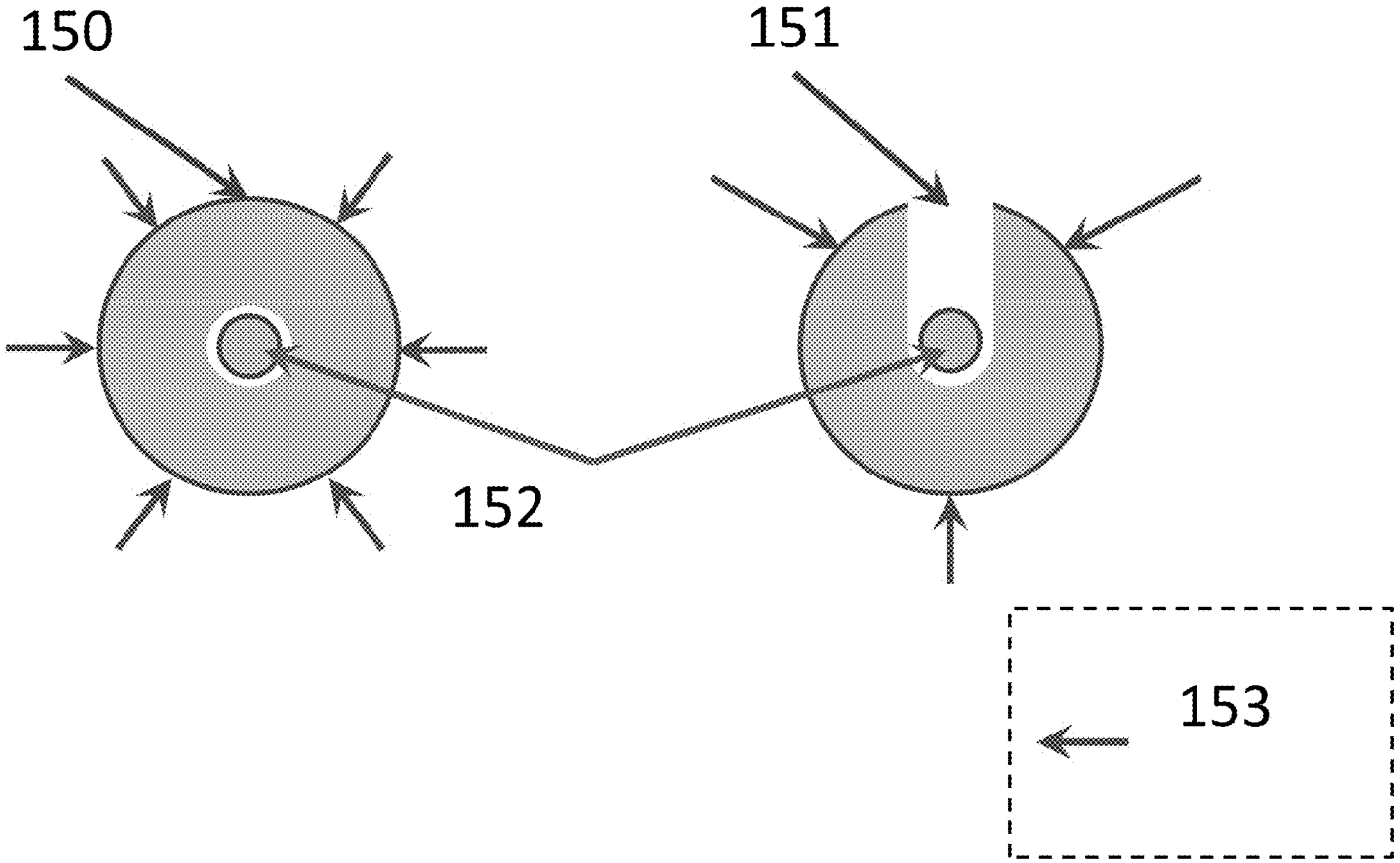
FIG. 13 is an end view of the ferule shown in FIG. 12 according to the invention.

FIG. 13 is an end view of the ferule shown in FIG. 12 according to the invention. A ferrule is crimped onto the coax conductor as described above. The ferrule is made from soft metal, such as copper. On crimping the ferrule plastically deforms around the center conductor of the coax. The ferrule may be a closed ferrule 150 having a hole into which the conductor 152 is inserted before the ferrule is deformed by a crimp force 153 to capture the conductor.

While the hole is concentric it may also be off-center. A further embodiment provides for the ferrule to be open such that a conductor may be laid into the open slot then crimped from either side of the slot to capture the conductor. The open slot in the ferrule 151 now makes it open. This eliminates the need to chamfer or fillet the original hole (see FIG. 14, discussed below). By applying pressure more toward the top of the slot the slot can be crimped closed as with a sinker to a fishing line.

Figure 14:
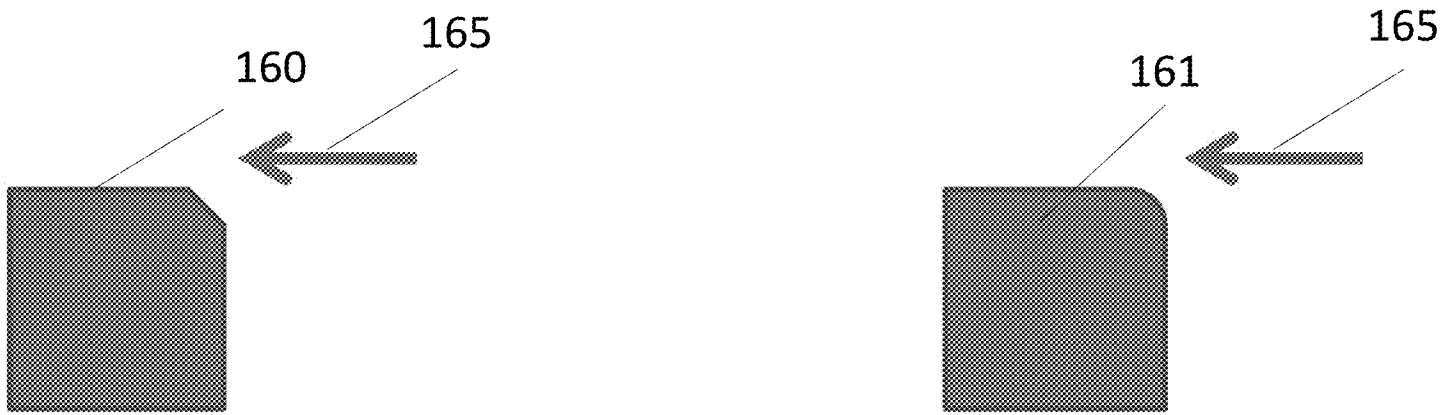
FIG. 14 is a side view showing a chamber and a filet according to the invention.

FIG. 14 is a side view showing a chamfer and a filet for a closed ferrule opening according to the invention. The openings along the axis 165 of a hole that extends between at the two ends of the ferrule can be chamfered 160 or filleted 161 to make the conductor easier to enter the hole of a closed ferrule.

Figure 15:
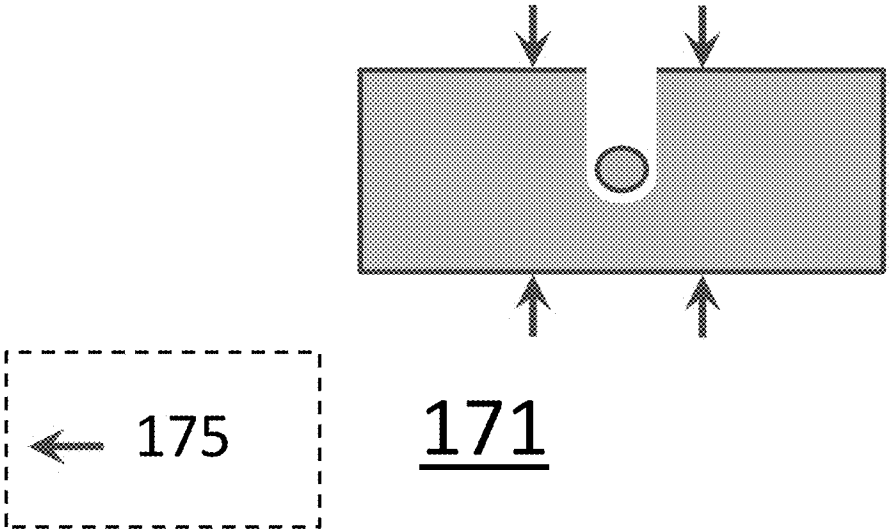
FIG. 15 is an end view of an open puck according to the invention.

FIG. 15 is an end view of an open puck according to the invention. Embodiments of the invention discussed above show the ferrule as a cylinder. Another embodiment provides for multiple conductors to be laid into multiple slots or holes and crimped by application of a crimp force 175 to cause plastic deformation of the surrounding ferrule material. One such example is a puck 171 having radial slots into which the conductors are laid. The ferrule material is then plastically deformed between the slots.

Figure 16:
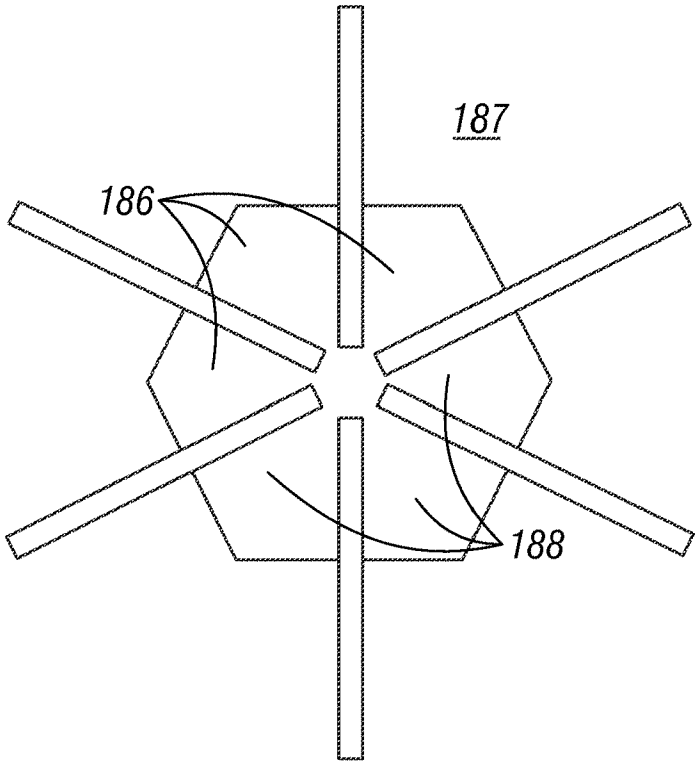
FIG. 16 is a plan view showing an in-line crimp, offset crimp, T-crimp, and hex crimp according to the invention.
Figure 16:
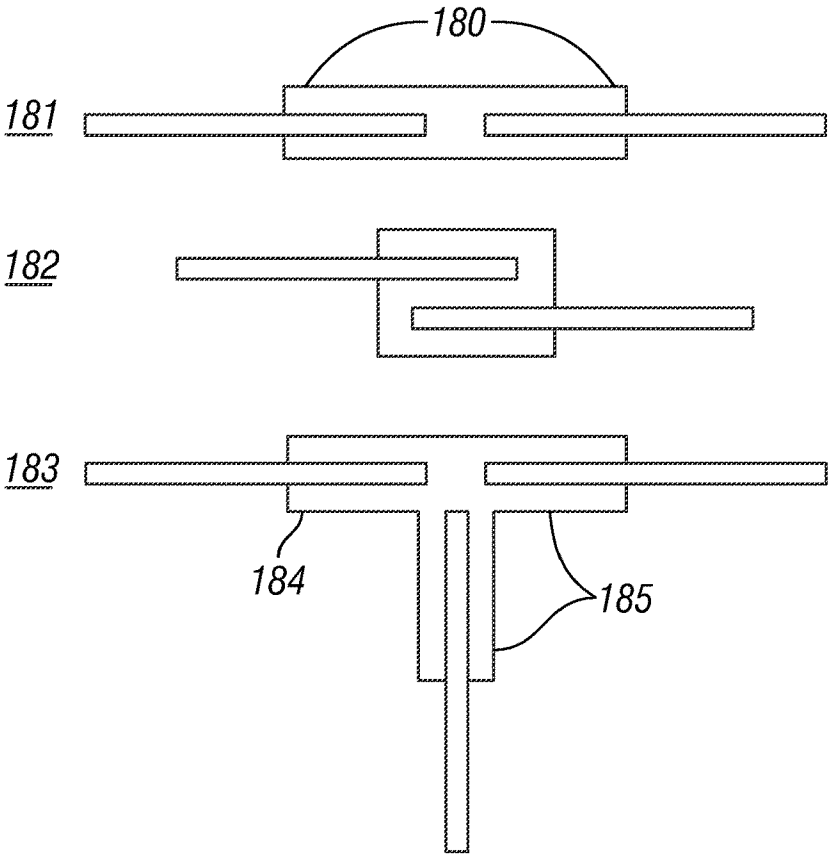

FIG. 16 is a plan view showing an in-line crimp, offset crimp, T-crimp, and hex crimp according to the invention. In the embodiments discussed above, a single conductor ferrule is required. There are situations where the connection of multiple conductors at a single node is required as part on an antenna assembly. FIG. 16 shows such center conductor examples, including a crimp around arrangement 181 for connecting two conductors in line by application of crimping force 181; an arrangement 182 for connecting two or more conductors in parallel; an arrangement for connecting two or more conductors in a non-parallel way, such as at right angles or some other convenient angle set, e.g. as an arrangement 183 for connecting three conductors in a tee; and so on. It follows that all of these nodes can, in turn, connect to a second system by crimping in the same way as the ferrule described above. The foregoing embodiments can connect as a system of tubular ferrules. The same system can also be constructed as a puck 187 with multiple entries via, for example, indentations 186, 188.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. A multiple band, end fed dipole antenna, comprising:
- a first metal sheet, folded to define a first antenna segment comprising:
  - a high band radiator;
  - a first folded three-sided three-dimensional sleeve defining a low band trap;
  - a second folded three-sided three-dimensional sleeve defining a first high band trap;
  - a coax saddle extending continuously from said low band trap to said first high band trap; and
  - at least one end feed coax shield crimp point formed along said coax saddle;
- a second metal sheet, folded to define a second antenna segment comprising:
  - a low band radiator;
  - a third folded three-sided three-dimensional sleeve defining a second high band trap; and
  - a coax center conductor contact point; and
- a dielectric spacer rigidly attached to, and establishing a non-conductive gap between, said first antenna segment and said second antenna segment.

2. The antenna of claim 1, wherein said antenna operates in a low band at or around 2.45 GHz and a high band at or around 5.5 GHz.

3. The antenna of claim 1, wherein:
- the first folded three-sided three-dimensional sleeve defining the low band trap is formed by applying a first axial 180° bend at a first location along the first metal sheet;
- the second folded three-sided three-dimensional sleeve defining the first high band trap is formed by applying a second axial 180° bend at a second location along the first metal sheet; and
- the third folded three-sided three-dimensional sleeve defining the second high band trap is formed by applying a third axial 180° bend at a third location along the second metal sheet.

4. The antenna of claim 1, further comprising:
- a spacer alignment pin axially projecting from each end of said spacer; and
- a complementary alignment hole formed in each of said first and second antenna segments for matingly receiving a respective one of said spacer alignment pins therein.

5. The antenna of claim 1, further comprising:
- a plurality of crimp points along said saddle for crimping a shield of a coax cable to an antenna ground system.

6. The antenna of claim 1, further comprising:
- a coax cable arranged along the coax saddle, the coax cable including a coax center conductor; and
- a crimp point at said coax center conductor contact point for crimping the coax center conductor to said second antenna segment.

7. The antenna of claim 6, the crimp point comprising two crimping lugs, each lug folded back on itself to provide a coax center conductor capture mechanism.

8. The antenna of claim 6, the crimp point comprising a two-part mechanism including a crimp and a lock, wherein the crimp is bent onto the coax center conductor and the lock is bent over the crimp.

9. The antenna of claim 6, further comprising any of:

an in-line crimp, an offset crimp, a T-crimp, and a hex crimp.

10. The antenna of claim 6, further comprising any of:

a crimp around arrangement for connecting two conductors in line;

an arrangement for connecting two or more conductors in parallel;

an arrangement for connecting two or more conductors in a non-parallel way;

an arrangement for connecting three conductors in a tee; and a puck with multiple entries via a plurality of indentations formed therein.

11. The antenna of claim 1, further comprising:

a coax cable arranged along the coax saddle, the coax cable including a coax center conductor; and a soft metal ferrule swaged onto the coax center conductor;

wherein the ferrule and coax center conductor form an assembly that is crimped into a crimp point at the coax center conductor contact point.

12. The antenna of claim 11, said ferrule configured as a closed ferrule having a hole therethrough into which the coax center conductor is inserted before the ferrule is swaged.

13. The antenna of claim 12, further comprising:

a chamfer or fillet at each end of the ferrule hole.

14. The antenna of claim 11, said ferrule configured as an open ferrule to allow the coax center conductor to be laid into an open slot thereof and then crimped from either side of the slot to capture the coax center conductor.

15. The antenna of claim 11, wherein said ferrule comprises any of a cylinder and a puck having radial slots into which the coax center conductor is laid.

* * * * *